US009642460B2

(12) United States Patent
Chen et al.

(10) Patent No.: US 9,642,460 B2
(45) Date of Patent: May 9, 2017

(54) SELF-CLOSING SLIDE RAIL ASSEMBLY AND SELF-CLOSING MECHANISM THEREOF

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Yi-Syuan Jhao, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 185 days.

(21) Appl. No.: 14/311,422

(22) Filed: Jun. 23, 2014

(65) Prior Publication Data

US 2015/0366345 A1 Dec. 24, 2015

(51) Int. Cl.
*A47B 88/04* (2006.01)
*A47B 88/467* (2017.01)

(52) U.S. Cl.
CPC ..... *A47B 88/047* (2013.01); *A47B 88/467* (2017.01); *A47B 2088/0474* (2013.01); *A47B 2088/4675* (2017.01)

(58) Field of Classification Search
CPC ..... A47B 88/04; A47B 88/047; A47B 88/12; A47B 2088/0474
See application file for complete search history.

(56) References Cited

U.S. PATENT DOCUMENTS

| | | | | |
|---|---|---|---|---|
| 6,712,435 | B2 | 3/2004 | Kim et al. | |
| 6,733,097 | B2 | 5/2004 | Kim et al. | |
| 6,971,729 | B1 | 12/2005 | Kim et al. | |
| 6,997,528 | B2 * | 2/2006 | Yang | A47B 88/047 312/319.1 |
| 7,465,000 | B2 * | 12/2008 | Huang | A47B 88/047 312/333 |
| 7,537,296 | B2 * | 5/2009 | Leon | A47B 88/047 312/333 |
| 7,600,828 | B2 * | 10/2009 | Chen | A47B 88/047 312/319.1 |
| 7,878,606 | B2 * | 2/2011 | Chen | A47B 88/047 312/333 |
| 8,277,002 | B2 * | 10/2012 | Perez | A47B 88/047 312/333 |

(Continued)

FOREIGN PATENT DOCUMENTS

TW EP 2850970 A1 * 3/2015 ..... A47B 88/047

*Primary Examiner* — Daniel J Troy
*Assistant Examiner* — Ryan A Doyle
(74) *Attorney, Agent, or Firm* — Rosenberg, Klein & Lee

(57) ABSTRACT

A self-closing slide rail assembly includes a first rail, a second rail, and a self-closing mechanism. The second rail is longitudinally displaceable relative to the first rail. The self-closing mechanism includes a housing, an elastic member, and a movable member. The housing is mounted on the first rail. The movable member is movable within the housing in response to the elastic energy released by the elastic member. The second rail is retracted relative to the first rail by the movable member upon engagement therewith when moving from an extended position toward a retracted position.

14 Claims, 18 Drawing Sheets

(56) References Cited

U.S. PATENT DOCUMENTS

| | | | | |
|---|---|---|---|---|
| 8,939,525 | B1 * | 1/2015 | Chen | A47B 88/047 312/333 |
| 2004/0183411 | A1 * | 9/2004 | Boks | A47B 88/047 312/333 |
| 2004/0239218 | A1 * | 12/2004 | Jurja | A47B 88/047 312/333 |
| 2006/0082266 | A1 | 4/2006 | Le et al. | |
| 2007/0182292 | A1 * | 8/2007 | Huang | E05B 65/464 312/221 |
| 2014/0265795 | A1 * | 9/2014 | Muller | A47B 88/10 312/334.46 |

* cited by examiner

SELF-CLOSING SLIDE RAIL ASSEMBLY AND SELF-CLOSING MECHANISM THEREOF

FIELD OF THE INVENTION

The present invention relates to slide rails and more particularly to a self-closing slide rail assembly with a self-closing mechanism having a movable member whose actuating portion is engaged with a second rail (a movable rail) when the second rail enters the last part of its course of retraction and which therefore can automatically drive the second rail back to the retracted position.

BACKGROUND OF THE INVENTION

Generally speaking, a drawer or the like can be pulled out of or pushed back into a frame (e.g., a cabinet) by means of slide rails, and the pulling or pushing process is accomplished mostly by the force exerted by the operator. Currently, the market is also supplied with products featuring automatic slide rail retraction, in which the slide rails are automatically retractable so that a drawer pushed toward the retracted position and having entered the last part of its retracting course can be automatically driven to the retracted position.

Designs of such automatically retractable slide rails are disclosed in U.S. Pat. Nos. 6,712,435; 6,733,097; 6,971,729; and 7,878,606 and US Patent Application Publication No. 2006/082266A1.

The '435 patent discloses a self-closing slide which, according to FIG. 2A, FIG. 2B, FIG. 3, and FIG. 16 of the patent specification, includes an automatic returning mechanism (46) mounted at an end portion of an outer slide member (16). The automatic returning mechanism (46) generally includes a housing (48), a spring (86) located in the housing (48), a pin (78) extending through the spring (86), and a slot (90). The slot (90) includes a longitudinal portion (92) and a transverse portion (100) extending transversely with respect to the longitudinal portion (92). The slot (90) is provided therein with an actuator guide member (108) displaceable between the transverse portion (100) and the longitudinal portion (92). In addition, an inner slide member (12) has an end portion formed with a first slot portion (110) and a second slot portion (114). The first slot portion (110) at the end portion of the inner slide member (12) corresponds to the actuator guide member (108) in the housing (48) of the automatic returning mechanism (46). When the inner slide member (12) is displaced toward a retracted position, the actuator guide member (108) is guided by the first slot portion (110) and the second slot portion (114) of the inner slide member (12) and, thanks to the elastic energy provided by the spring (86) along the pin (78), retracts the inner slide member (12) automatically. Thus, the objective of providing a self-closing slide is achieved.

It can be known from the patents and patent application cited above that automatically retractable slide rails are diversified in design, which reflects the market demand for such products. Therefore, it has been an important issue in the industry to develop practical and easy-to-operate self-closing slide rails.

SUMMARY OF THE INVENTION

The present invention relates to a self-closing slide rail assembly.

According to one aspect of the present invention, a self-closing slide rail assembly includes a first rail, a second rail, and a self-closing mechanism. The second rail can be longitudinally displaced relative to the first rail. The second rail includes a guide portion and a stop portion close to the guide portion. The guide portion and the stop portion define a first positioning groove therebetween. The self-closing mechanism is mounted on the first rail and includes a housing, an elastic member, a movable member, and an actuating portion. The housing includes a longitudinal portion, a first transverse portion connected to the longitudinal portion, a first edge substantially parallel to the longitudinal portion, a second edge deflecting from the first edge, and an engaging portion located at the second edge. The elastic member is located in the longitudinal portion of the housing. The movable member is movably connected to the housing and includes a first side and a second side opposite the first side. The first side includes a first projection and a second projection. The first projection is pressed against the elastic member. The second projection corresponds to the first transverse portion and is movable along the first edge. The actuating portion is connected to the second side of the movable member. The actuating portion corresponds to the first positioning groove between the guide portion and the stop portion of the second rail. When the actuating portion of the self-closing mechanism is engaged in the first positioning groove of the second rail and the second rail is displaced relative to the first rail from a retracted position toward an extended position, the second projection of the movable member is moved from the first edge to the second edge and enters into engagement with the engaging portion. Meanwhile, the elastic member of the self-closing mechanism stores elastic energy. When the second rail is displaced relative to the first rail from the extended position toward the retracted position, the guide portion of the second rail guides the actuating portion of the self-closing mechanism into engagement in the first positioning groove of the second rail. As a result, the second projection of the movable member leaves the engaging portion, and the elastic member of the self-closing mechanism releases the elastic energy such that the second projection of the movable member is moved from the second edge to the first edge. The movable member thus drives the second rail back to the retracted position automatically.

Preferably, the housing of the self-closing mechanism further includes a channel filled with a cushioning medium; the self-closing slide rail assembly further includes an auxiliary member, wherein the auxiliary member has a sliding portion corresponding to the channel, a first vertical wall, and a second vertical wall opposite the first vertical wall; the second projection of the movable member is located between the first vertical wall and the second vertical wall of the auxiliary member; and the auxiliary member further includes a lateral extension portion corresponding to the movable member.

Preferably, the second rail further includes a hook portion close to the stop portion, the hook portion and the stop portion define a second positioning groove therebetween, and the second positioning groove corresponds to the actuating portion of the self-closing mechanism.

Implementation of the present invention produces the following advantageous effects. First, the self-closing mechanism is so designed that the second rail can be automatically driven to the retracted position by the movable member of the self-closing mechanism when moved relative to the first rail from the extended position toward the retracted position. Second, by mounting the auxiliary member in the channel of the housing, the impact force and noise resulting from the movable member driving the second rail to the retracted position are both reduced.

BRIEF DESCRIPTION OF THE DRAWINGS

The invention as well as a preferred mode of use and the advantages thereof will be best understood by referring to the following detailed description of some illustrative embodiments in conjunction with the accompanying drawings, in which.

DETAILED DESCRIPTION OF THE INVENTION

Figure 1:
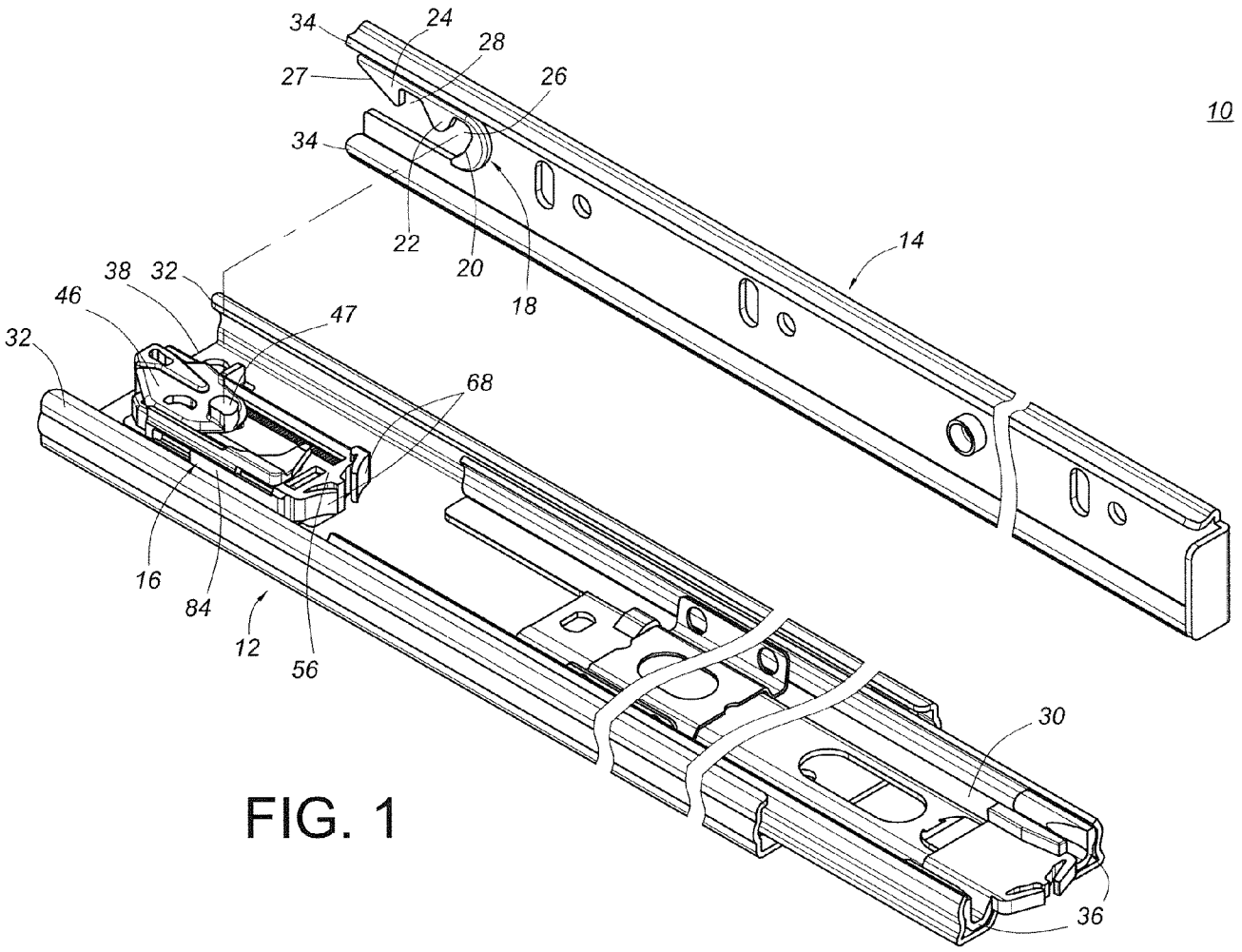
FIG. 1 schematically shows how a self-closing mechanism is mounted in the self-closing slide rail assembly in an embodiment of the present invention.
Figure 2:
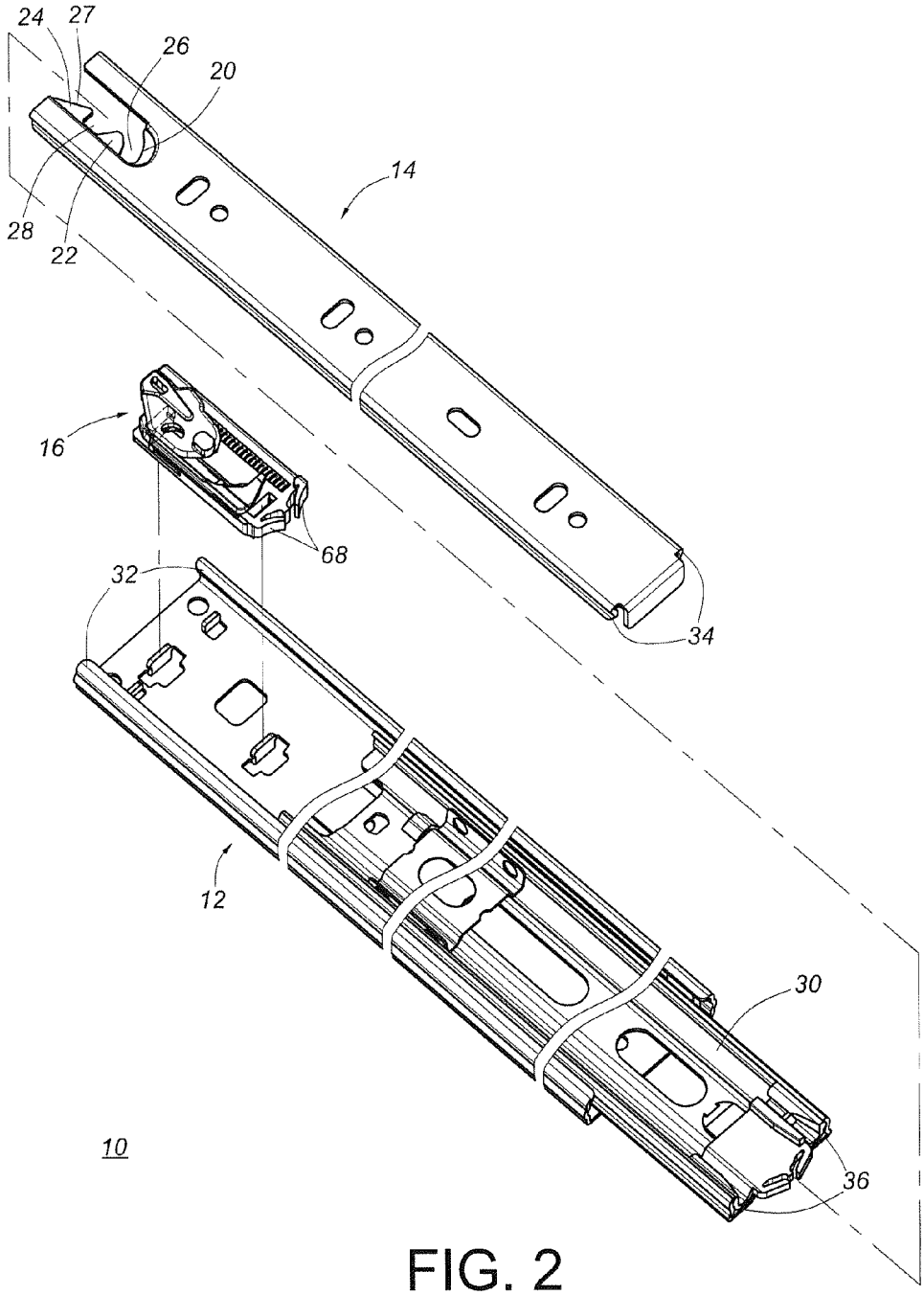
FIG. 2 is an exploded view of the self-closing slide rail assembly in an embodiment of the present invention.

Referring to FIG. 1 and FIG. 2, a self-closing slide rail assembly 10 in an embodiment of the present invention includes a first rail 12, a second rail 14, and a self-closing mechanism 16. Preferably, the self-closing slide rail assembly 10 further includes a third rail 30.

The second rail 14 can be longitudinally displaced relative to the first rail 12. The second rail 14 includes an end portion 18 corresponding to the self-closing mechanism 16. In addition, the second rail 14 includes a guide portion 20, a stop portion 22 close to the guide portion 20, and a hook portion 24 close to the stop portion 22. In one preferred embodiment, the guide portion 20, the stop portion 22, and the hook portion 24 are adjacent to the end portion 18 of the second rail 14. The guide portion 20 has a curved guide surface but is not so limited. A first positioning groove 26 is defined between the guide portion 20 and the stop portion 22, and a second positioning groove 28 is defined between the stop portion 22 and the hook portion 24. The hook portion 24 has an inclined side 27.

The third rail 30 serves to extend the distance for which the second rail 14 can slide relative to the first rail 12. More specifically, each of the first rail 12, the second rail 14, and the third rail 30 includes a pair of walls 32, 34, 36. The walls 36 of the third rail 30 correspond to and are mounted in the walls 32 of the first rail 12 respectively. Similarly, the walls 34 of the second rail 14 correspond to and are mounted in the walls 36 of the third rail 30 respectively. Both the second rail 14 and the third rail 30 are therefore longitudinally displaceable relative to the first rail 12.

The self-closing mechanism 16 is mounted on the first rail 12. In practice, the self-closing mechanism 16 can be mounted on the first rail 12 at a position adjacent to an end portion 38 of the first rail 12 by threaded connection, riveting, soldering, adhesive connection, or projection-recess engagement, without limitation. Preferably, the self-closing mechanism 16 has an end portion provided with at least one cushioning arm 68. The cushioning arms 68 are configured for pressing against and thereby cushioning the third rail 30 when the third rail 30 is retracted relative to the first rail 12 toward a retracted position.

Figure 3:
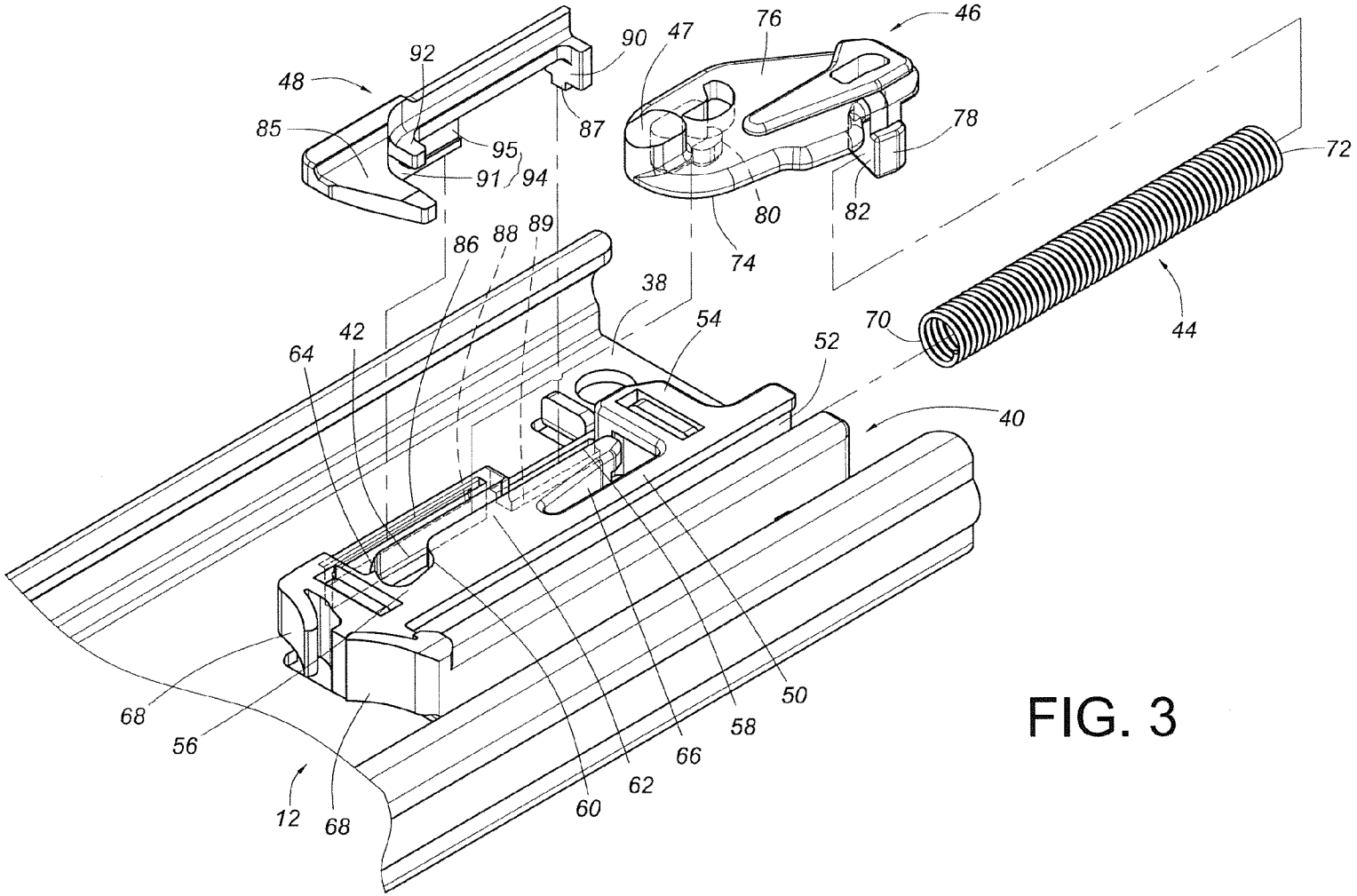
FIG. 3 shows how the self-closing mechanism, depicted in an exploded view, is mounted on the first rail of the self-closing slide rail assembly in an embodiment of the present invention.
Figure 3A:
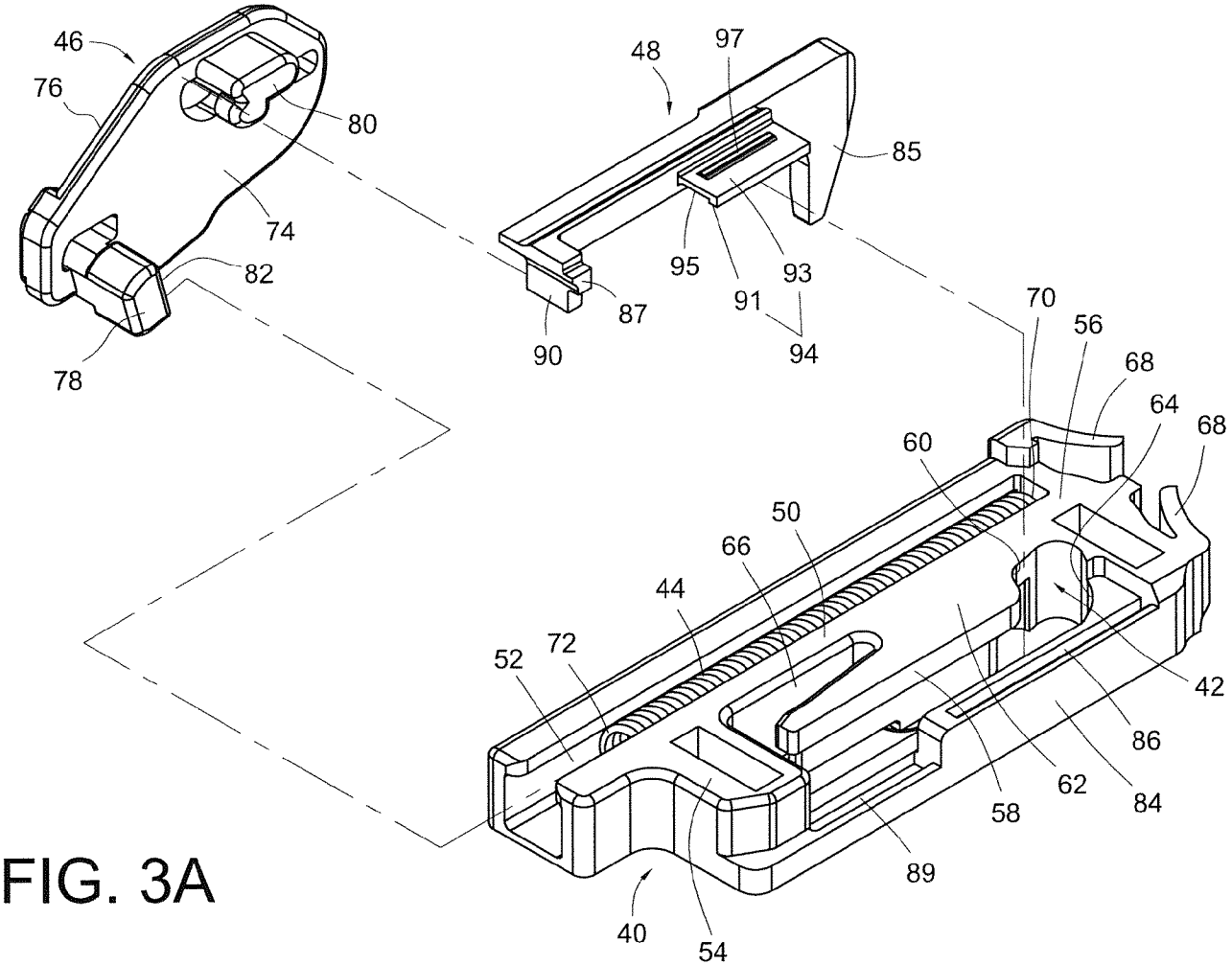
FIG. 3A is an exploded view of the self-closing mechanism in an embodiment of the present invention.

As shown in FIG. 3 and FIG. 3A, the self-closing mechanism 16 includes a housing 40, an elastic member 44, and a movable member 46.

The housing 40 is mounted on the first rail 12 and is adjacent to the end portion 38 of the first rail 12. The housing 40 includes a longitudinal portion 50, an accommodation space 52, a first transverse portion 54, a second transverse portion 56, a first edge 58, a second edge 60, and a longitudinal wall 62. The accommodation space 52 is in the longitudinal portion 50. The first transverse portion 54 is transversely connected to the longitudinal portion 50. The second transverse portion 56 corresponds in position to the first transverse portion 54 and is transversely connected to the longitudinal portion 50.

More specifically, the first edge 58 and the second edge 60 form an included angle therebetween, the first edge 58 is substantially parallel to the longitudinal portion 50, and the second edge 60 deflects from the first edge 58. The second transverse portion 56 has a curved surface 64 corresponding in position to the second edge 60. The longitudinal wall 62 has a portion connected to the longitudinal portion 50 and is substantially parallel to the longitudinal portion 50 such that a space 66 is formed between the longitudinal wall 62 and the longitudinal portion 50. The first edge 58 is located on the longitudinal wall 62.

The housing 40 of the self-closing mechanism 16 includes an engaging portion 42 having an engaging surface. The engaging portion 42 is adjacent to the second edge 60 and is defined between the longitudinal wall 62 and the second transverse portion 56. In one preferred embodiment, the engaging portion 42 is located between the wall body of the longitudinal wall 62, the wall body of the longitudinal portion 50, and the wall body of the second transverse portion 56. The elastic member 44 is in the accommodation space 52 of the longitudinal portion 50. The elastic member 44 has a first end 70 and a second end 72 opposite the first end 70. The first end 70 corresponds to and presses against an inner wall of the accommodation space 52 of the longitudinal portion 50.

The movable member 46 corresponds to and is movably connected to the housing 40. The movable member 46 includes a first side 74 and a second side 76 opposite the first side 74. The first side 74 includes a first projection 78 and a second projection 80. The first projection 78 has a surface 82 corresponding to, and configured for pressing against, the second end 72 of the elastic member 44. The second side 76 includes an actuating portion 47. Here, the actuating portion 47 is integrally connected to the second side 76 of the movable member 46, but the present invention is not limited to this configuration.

Figure 4:
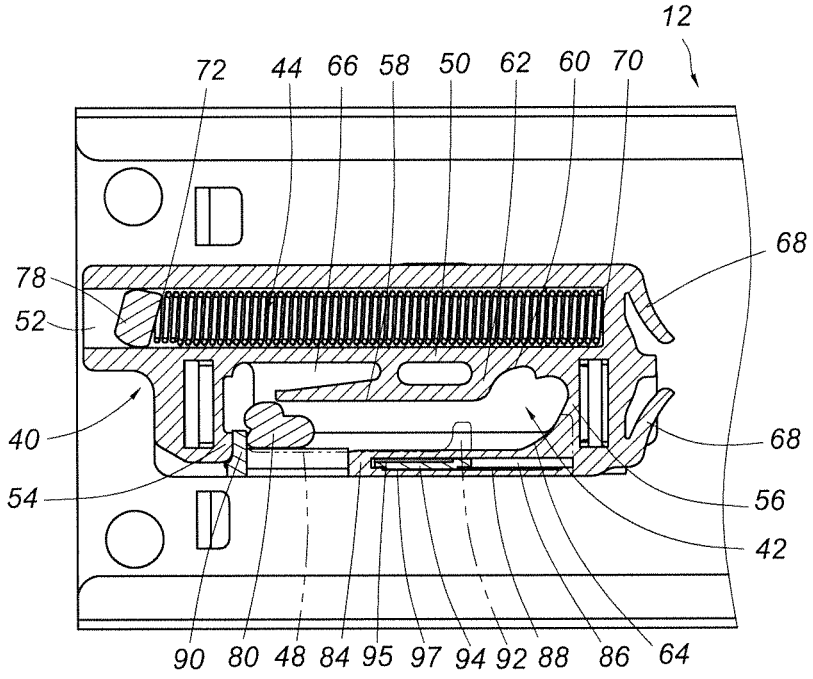
FIG. 4 is a schematic drawing in which the second projection of the movable member of the self-closing slide rail assembly in an embodiment of the present invention is adjacent to an end portion of the first edge.

Referring also to FIG. 4, the second projection 80 corresponds to the first transverse portion 54 of the housing 40 and, when the elastic member 44 is in an elastic energy releasing state, is directly or indirectly pressed against a portion of the housing 40 that is adjacent to the first transverse portion 54. Here, the self-closing slide rail assembly 10 further includes an auxiliary member 48, through which the second projection 80 is pressed indirectly against a portion of the housing 40 that is adjacent to the first transverse portion 54 in order to keep the elastic member 44 from springing out of the accommodation space 52 of the housing 40. Besides, the second projection 80 of the movable member 46 corresponds in shape to the engaging portion 42.

Figure 5A:
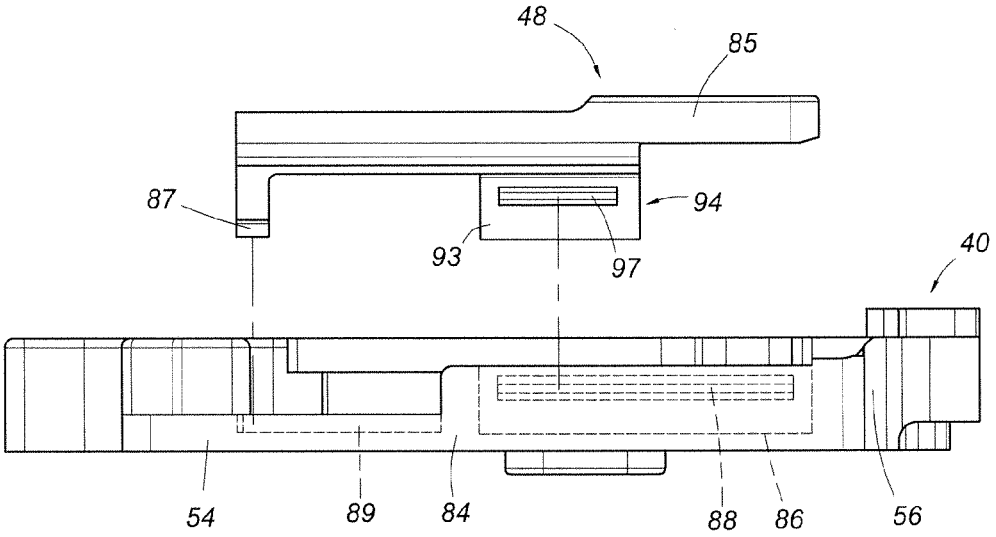
FIG. 5A is a bottom view of the housing of the self-closing mechanism and the auxiliary member in an embodiment of the present invention.
Figure 5B:
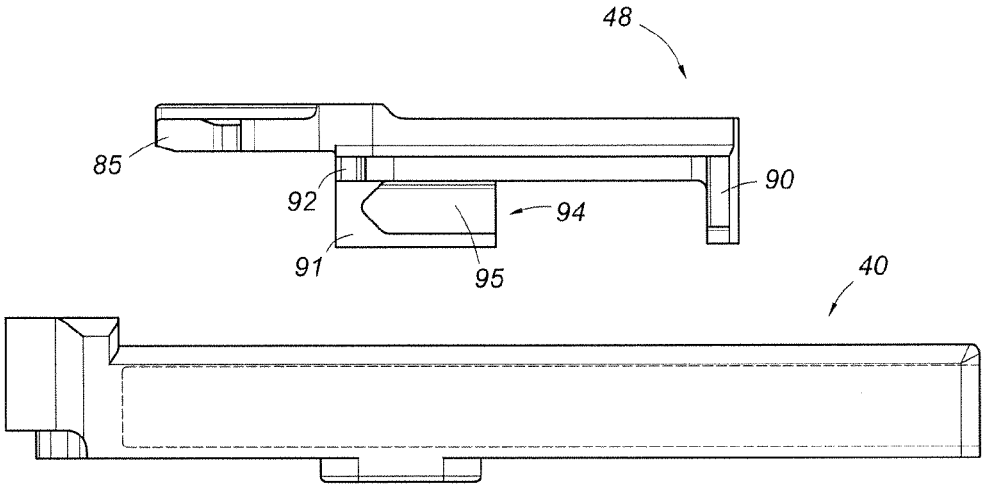
FIG. 5B is a top view of the housing of the self-closing mechanism and the auxiliary member in an embodiment of the present invention.

Reference is now made to FIG. 3 and FIG. 3A in conjunction with FIG. 5A and FIG. 5B. FIG. 5A is a bottom view of the housing 40 and the auxiliary member 48, and FIG. 5B is a top view of the housing 40 and the auxiliary member 48. The first transverse portion 54 and the second transverse portion 56 are connected by a longitudinal wall portion 84. The longitudinal wall portion 84 includes a channel 86 in which a groove 88 is formed. Here, the longitudinal wall portion 84 includes another channel 89.

The auxiliary member 48 has a first vertical wall 90, a second vertical wall 92 opposite the first vertical wall 90, and a sliding portion 94 corresponding to the channel 86 of the longitudinal wall portion 84. The sliding portion 94 has a first portion 91 and a second portion 93 opposite the first portion 91. The first portion 91 has a recess 95. The second portion 93 has a rib 97 corresponding to the groove 88 of the channel 86. Thanks to the rib 97, the sliding portion 94 can be displaced stably in the channel 86 of the longitudinal wall portion 84.

The auxiliary member 48 further includes a sliding block 87 and a lateral extension portion 85. The sliding block 87 corresponds to the other channel 89 of the longitudinal wall portion 84, and the lateral extension portion 85 corresponds to the movable member 46 or the actuating portion 47 so as to ensure that the auxiliary member 48 can be driven by the movable member 46 when the movable member 46 is moved and that the auxiliary member 48 will not fall off from the movable member 46.

Figure 6A:
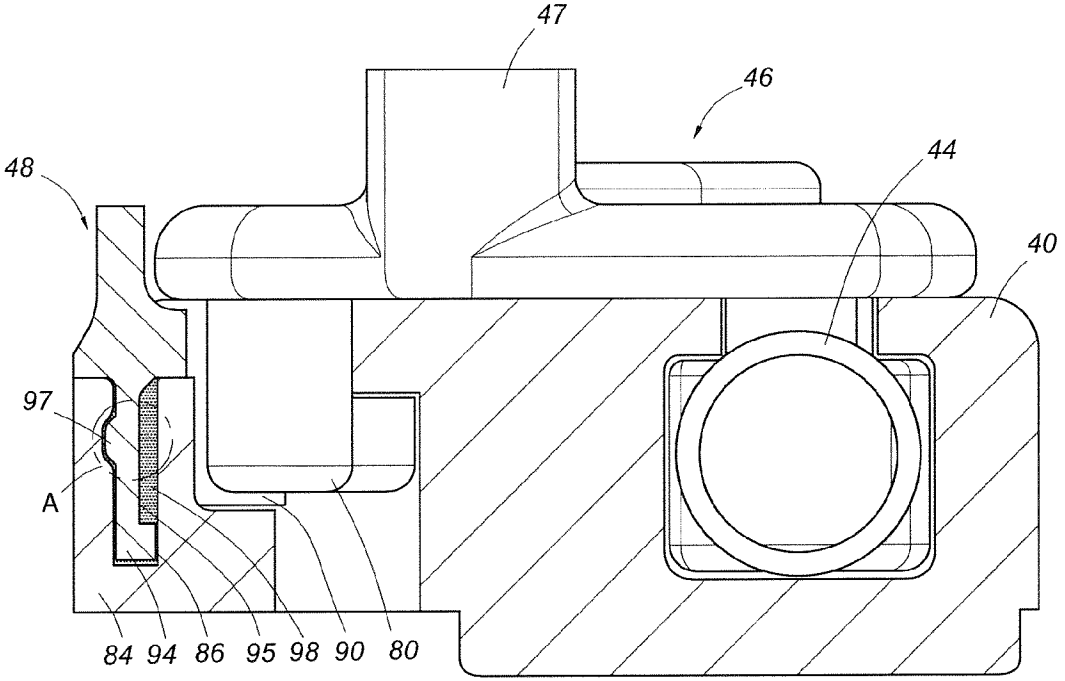
FIG. 6A schematically shows how the sliding portion of the self-closing mechanism in an embodiment of the present invention is mounted in the channel of a longitudinal wall portion.
Figure 6B:
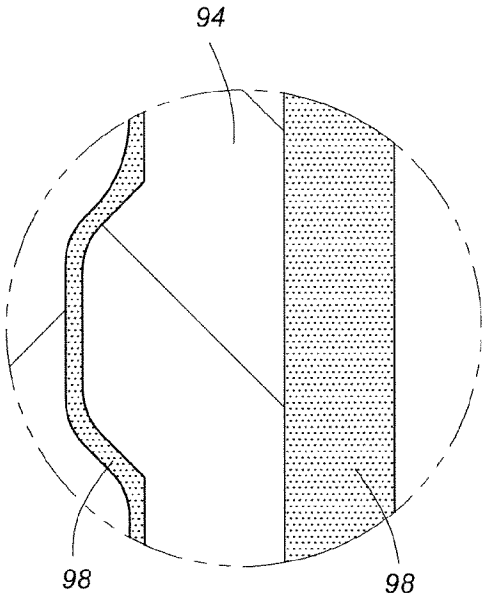
FIG. 6B is a partial enlarged view of FIG. 6A, showing in particular the cushioning medium in the channel.

As shown in FIG. 6A and FIG. 6B, the sliding portion 94 of the auxiliary member 48 is mounted in the channel 86 of the longitudinal wall portion 84 of the self-closing mechanism 16. The channel 86 of the longitudinal wall portion 84 is filled with a cushioning medium 98 for cushioning the sliding portion 94 of the auxiliary member 48 when the sliding portion 94 is moving in the channel 86. For example, the cushioning medium 98 in the channel 86 is attached to the entire sliding portion 94 of the auxiliary member 48 (including the recess 95 and the rib 97). When the auxiliary member 48 is driven toward a retracted position by the second projection 80 of the movable member 46, the cushioning medium 98 not only reduces the speed at which the sliding portion 94 of the auxiliary member 48 moves in the channel 86, but also prevents noise which may otherwise be caused by collision between an end portion of the sliding portion 94 of the auxiliary member 48 and an inner wall of the channel 86. Thus, the cushioning medium 98 provides both cushioning and muffling effects.

Figure 7:
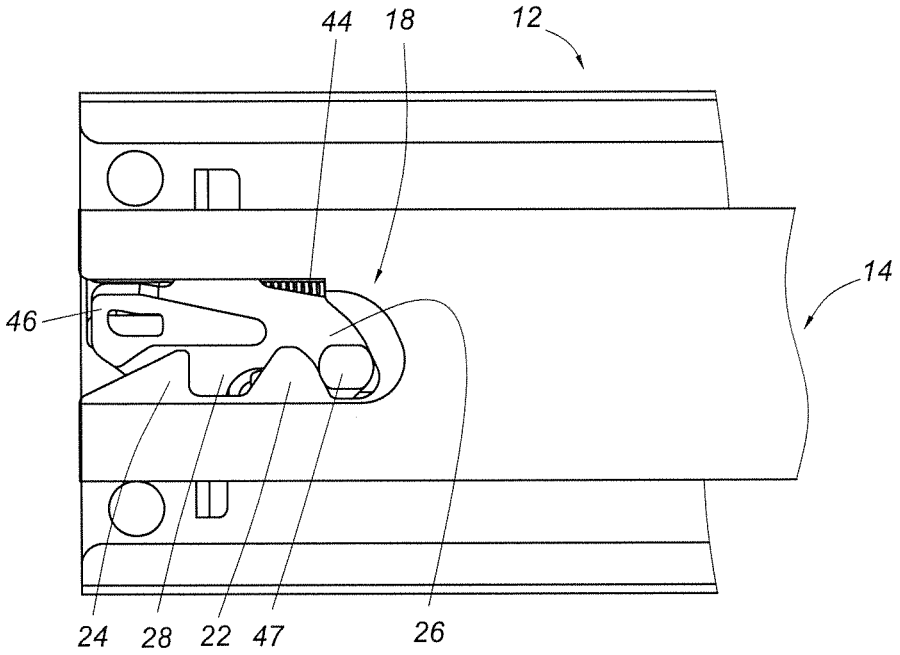
FIG. 7 is a schematic drawing in which the second rail of the self-closing slide rail assembly in an embodiment of the present invention is in a retracted position with respect to the first rail.

Please refer to FIG. 4 in conjunction with FIG. 7. In FIG. 4, the second projection 80 of the movable member 46 is close to an end portion of the first edge 58. In FIG. 7, the second rail 14 of the self-closing slide rail assembly 10 is in a retracted position with respect to the first rail 12.

As shown in FIG. 4 and FIG. 7, the second projection 80 of the movable member 46 lies between the first vertical wall 90 and the second vertical wall 92 of the auxiliary member 48. When at least a portion (e.g., the actuating portion 47) of the movable member 46 is engaged in the first positioning groove 26 of the second rail 14 and the second rail 14 is in the retracted position, the second projection 80 of the movable member 46 is pressed against the first transverse portion 54 of the housing 40 indirectly (i.e., via the first vertical wall 90 of the auxiliary member 48) and is adjacent to an end portion of the first edge 58 of the housing 40. Meanwhile, the first projection 78 of the movable member 46 is pressed against the second end 72 of the elastic member 44.

FIG. 8~FIG. 10 schematically show how the second rail 14 of the self-closing slide rail assembly 10 is displaced relative to the first rail 12 from the retracted position toward an extended position.

Figure 8A:
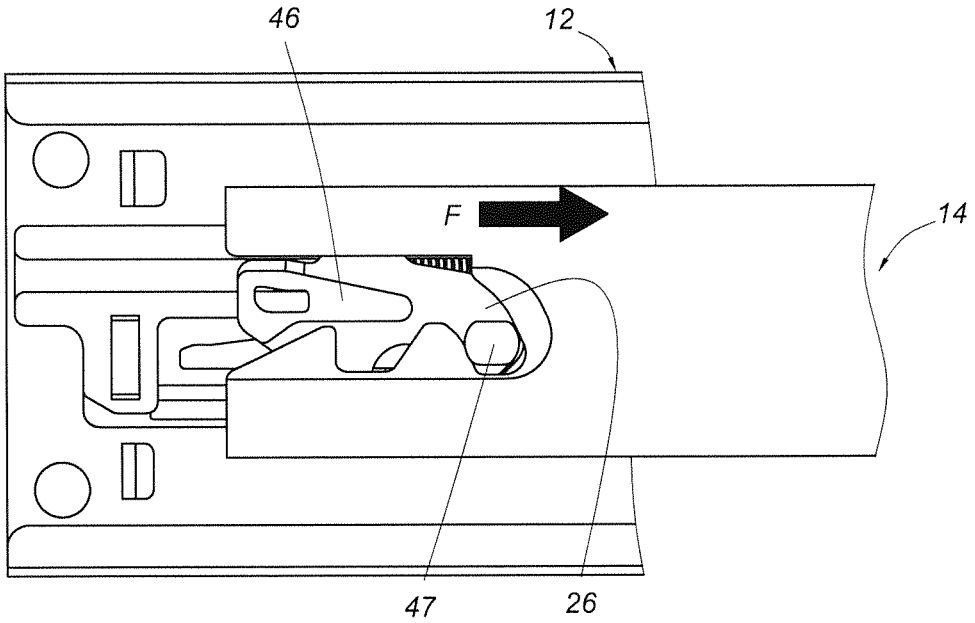
FIG. 8A schematically shows how the second rail of the self-closing slide rail assembly in an embodiment of the present invention is displaced relative to the first rail from a retracted position toward an extended position.
Figure 8B:
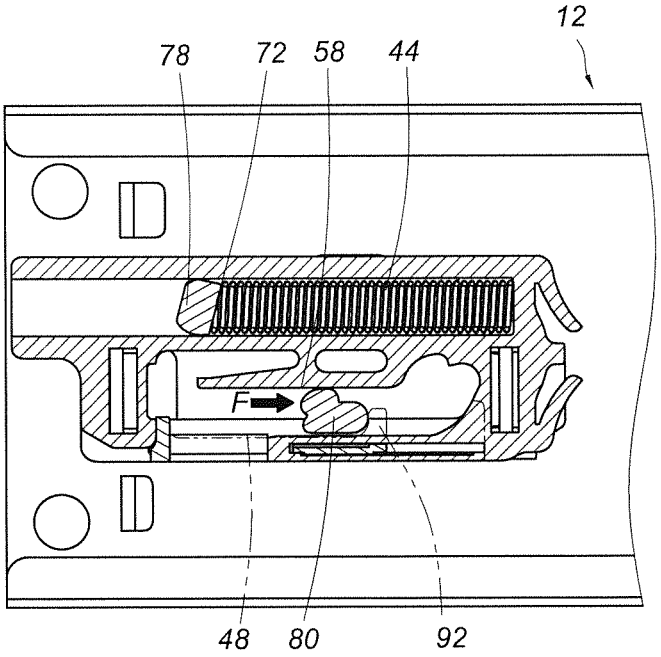
FIG. 8B schematically shows how the second projection of the movable member of the self-closing slide rail assembly in an embodiment of the present invention is driven by the second rail.

To begin with, referring to FIG. 8A and FIG. 8B, the actuating portion 47 of the movable member 46 is engaged in the first positioning groove 26 of the second rail 14. The second rail 14 is longitudinally displaced relative to the first rail 12 toward the extended position by an external force F such that the second projection 80 of the movable member 46 is displaced along the first edge 58. Once the second rail 14 comes to a certain position, the second projection 80 of the movable member 46 is pressed against the second vertical wall 92 of the auxiliary member 48 while the first projection 78 of the movable member 46 is pressed against the second end 72 of the elastic member 44.

Figure 9A:
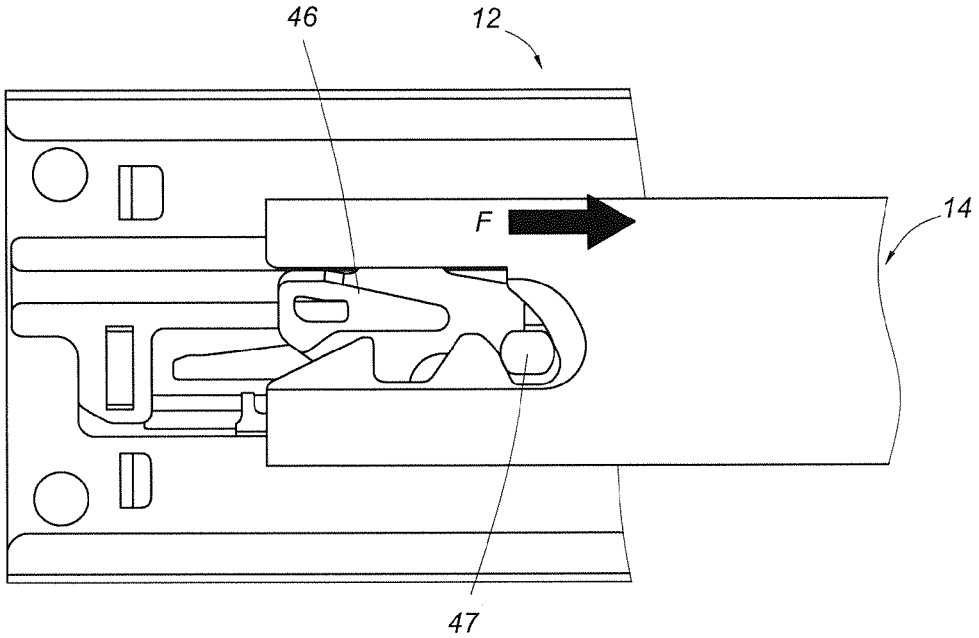
FIG. 9A schematically shows how the second rail of the self-closing slide rail assembly in an embodiment of the present invention is displaced relative to the first rail from a retracted position toward an extended position.
Figure 9B:
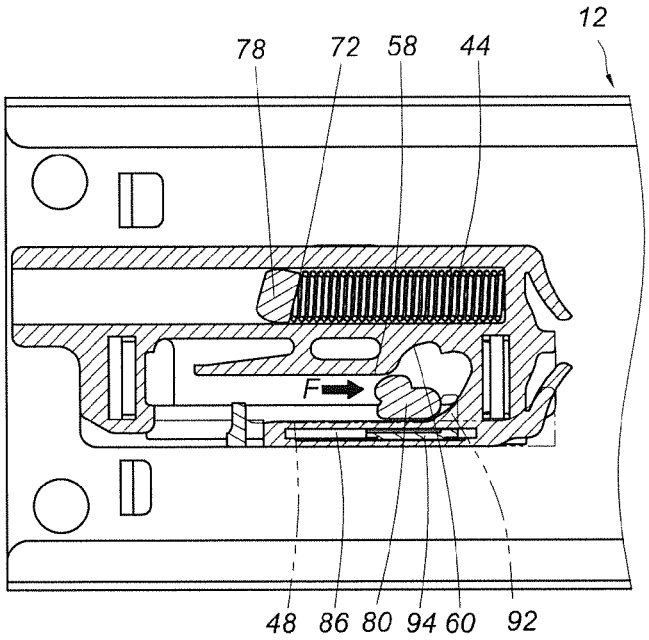
FIG. 9B schematically shows how the second projection of the movable member of the self-closing slide rail assembly in an embodiment of the present invention is driven by the second rail to the bend between the first edge and the second edge and how the auxiliary member is driven at the same time.

Referring to FIG. 9A and FIG. 9B, as the second rail 14 remains subjected to the external force F and keeps moving longitudinally toward the extended position, the second projection 80 of the movable member 46 is moved to the bend between the first edge 58 and the second edge 60. Now that the second projection 80 of the movable member 46 is still pressed against the second vertical wall 92 of the auxiliary member 48, the sliding portion 94 of the auxiliary member 48 is moved together with the movable member 46 along the channel 86 until the position shown in FIG. 9B is reached. In the process, the first projection 78 of the movable member 46 stays pressed against the second end 72 of the elastic member 44.

Figure 10A:
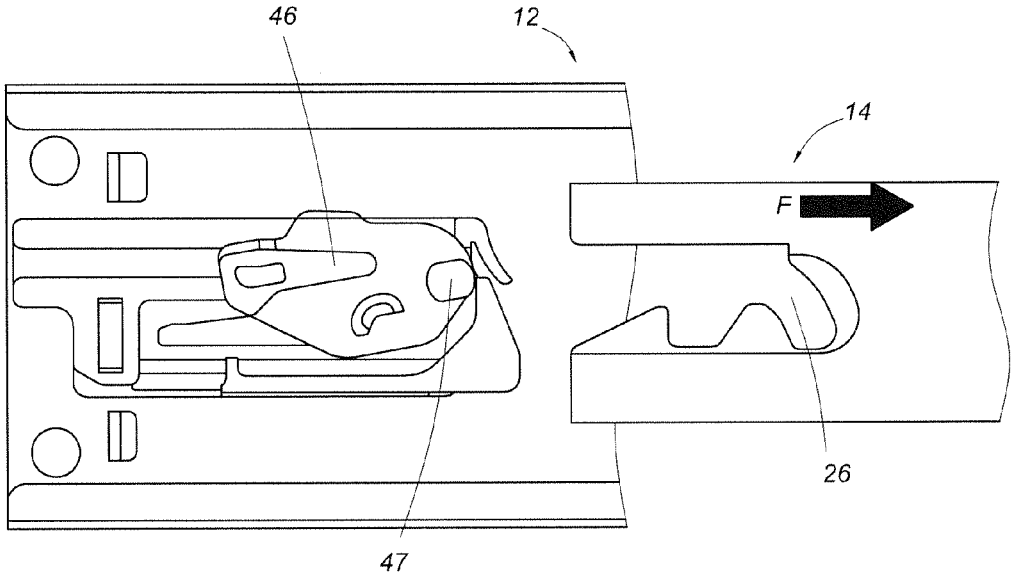
FIG. 10A schematically shows how the second rail of the self-closing slide rail assembly in an embodiment of the present invention is displaced relative to the first rail from a retracted position toward an extended position.
Figure 10B:
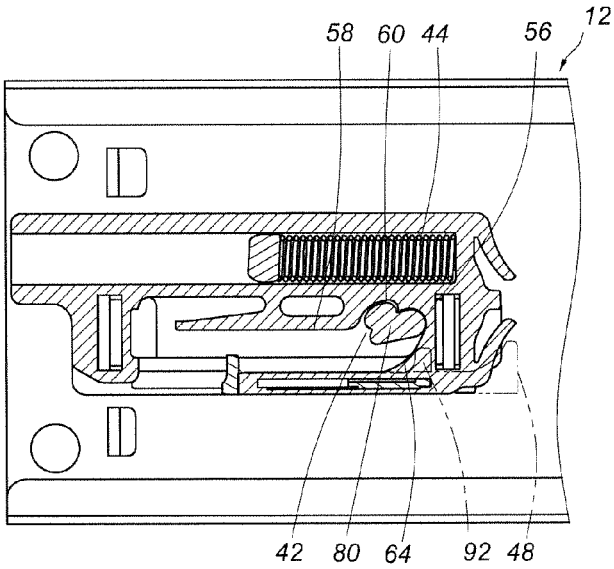
FIG. 10B is a schematic drawing in which the second projection of the movable member of the self-closing slide rail assembly in an embodiment of the present invention is engaged with an engaging portion adjacent to the second edge.

Referring to FIG. 10A and FIG. 10B, as the external force F continues displacing the second rail 14 longitudinally toward the extended position, the second projection 80 of the movable member 46 is moved from the first edge 58 to the second edge 60 and becomes engaged with the engaging portion 42. In other words, the movable member 46 is engaged with the engaging portion 42 when moved to the second edge 60. More specifically, the second projection 80 of the movable member 46 is guided by the curved surface 64 of the second transverse portion 56 before engaging with the engaging portion 42. As a result, the second projection 80 of the movable member 46 is no longer pressed against the second vertical wall 92 of the auxiliary member 48 and leaves the auxiliary member 48 at a predetermined position. In the meantime, the elastic member 44 is in a compressed state and stores elastic energy.

FIG. 11~FIG. 13 schematically show how the second rail 14 of the self-closing slide rail assembly 10 is displaced relative to the first rail 12 from the extended position to the retracted position.

Figure 11A:
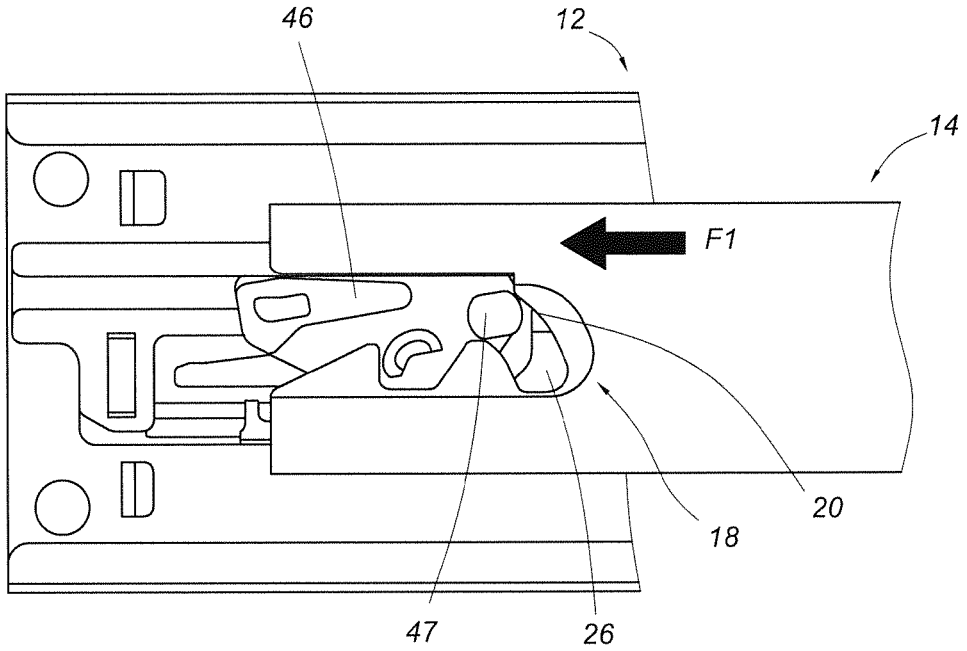
FIG. 11A schematically shows how the second rail of the self-closing slide rail assembly in an embodiment of the present invention is displaced relative to the first rail from an extended position toward a retracted position.
Figure 11B:
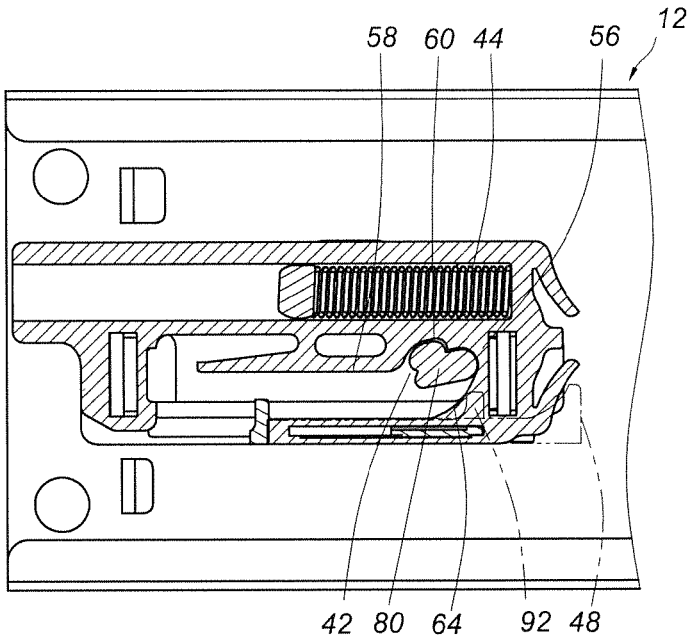
FIG. 11B is a schematic drawing in which the second projection of the movable member of the self-closing slide rail assembly in an embodiment of the present invention is engaged with the engaging portion adjacent to the second edge.

Referring to FIG. 11A and FIG. 11B, when the second rail 14 is subjected to an external force F1 and is thereby longitudinally displaced relative to the first rail 12 from the extended position toward the retracted position, the guide portion 20 at the end portion 18 of the second rail 14 corresponds to the actuating portion 47 of the movable member 46, and the second projection 80 of the movable member 46 is within the engaging portion 42 of the second edge 60.

Figure 12A:
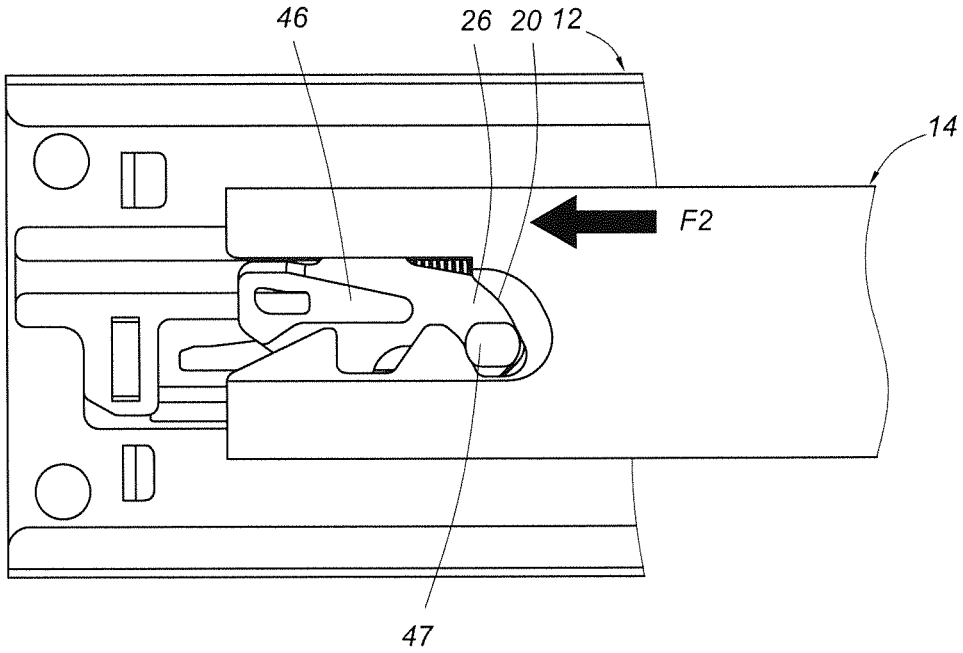
FIG. 12A schematically shows how the second rail of the self-closing slide rail assembly in an embodiment of the present invention is displaced relative to the first rail from an extended position toward a retracted position, with the actuating portion of the movable member engaged in the first positioning groove.
Figure 12B:
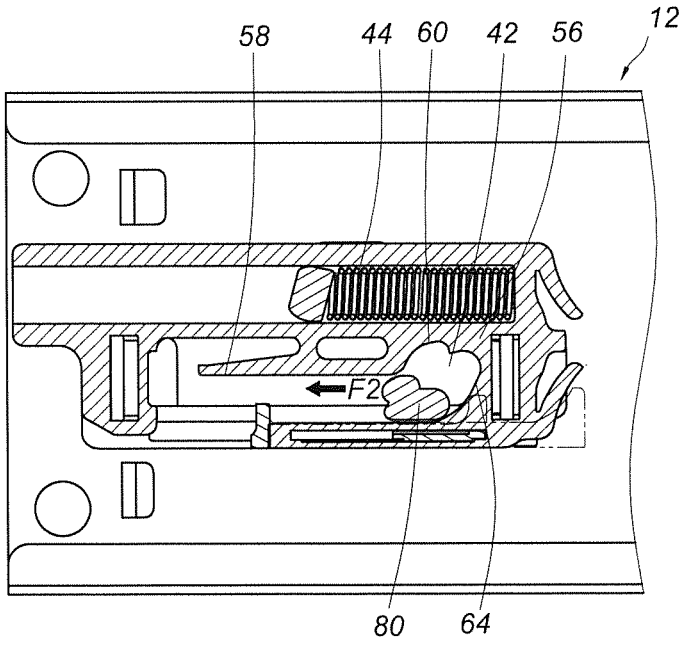
FIG. 12B schematically shows how the second projection of the movable member of the self-closing slide rail assembly in an embodiment of the present invention leaves the engaging portion.

Referring to FIG. 12A and FIG. 12B, after the actuating portion 47 of the movable member 46 is guided by the guide portion 20 of the second rail 14 into engagement with the first positioning groove 26 of the second rail 14, the second projection 80 of the movable member 46 is moved along the curved surface 64 of the second transverse portion 56 and thus leaves the engaging portion 42 of the second edge 60. Consequently, the elastic member 44 of the self-closing mechanism 16 releases the elastic energy F2, which drives the second projection 80 of the movable member 46 from the second edge 60 to the first edge 58, and thanks to the actuating portion 47 of the movable member 46, the second rail 14 is automatically pushed toward the retracted position.

Figure 13A:
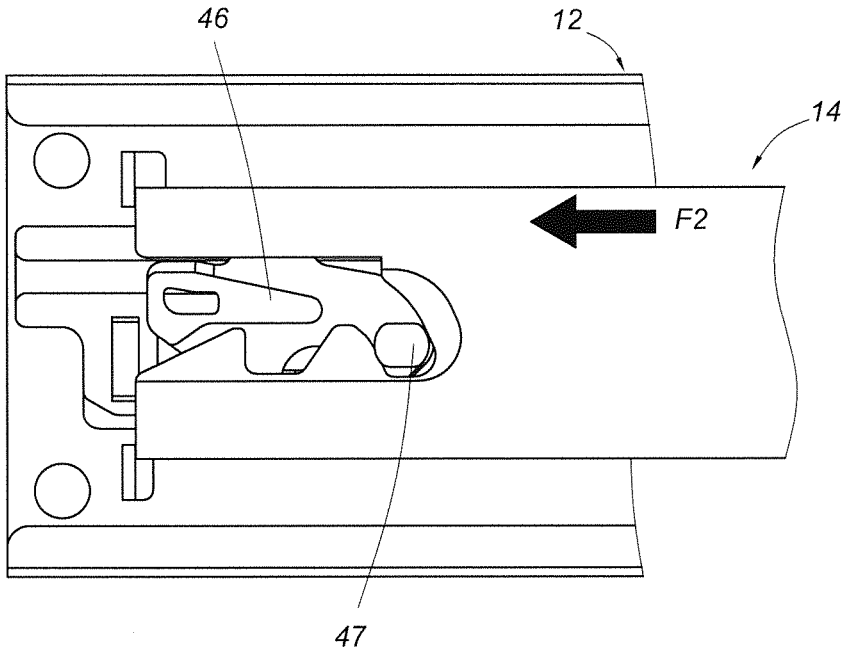
FIG. 13A is another schematic drawing showing how the second rail of the self-closing slide rail assembly in an embodiment of the present invention is displaced relative to the first rail from an extended position toward a retracted position, with the actuating portion of the movable member engaged in the first positioning groove.
Figure 13B:
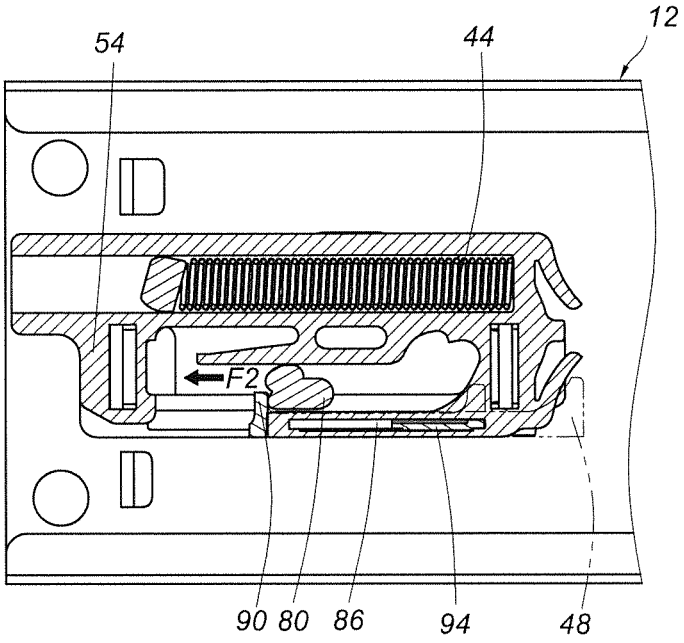
FIG. 13B schematically shows how the second projection of the movable member of the self-closing slide rail assembly in an embodiment of the present invention is driven by the elastic energy of an elastic member and how the second projection of the movable member is pressed against the first vertical wall of the auxiliary member.

Referring to FIG. 13A and FIG. 13B, once the actuating portion 47 of the movable member 46 is driven to a certain position by the elastic energy F2 released from the elastic member 44, the second projection 80 of the movable member 46 is pressed against the first vertical wall 90 of the auxiliary member 48. Then, the sliding portion 94 of the auxiliary member 48 is displaced in the channel 86, as shown in FIG. 4 and FIG. 7. After that, the auxiliary member 48 is driven to the retracted position along with the movable member 46, and the second rail 14 is driven to the retracted position by the movable member 46 and reenters the retracted state, in which the second projection 80 of the movable member 46 is pressed against the portion of the housing 40 that is adjacent to the first transverse portion 54 in an indirect manner (i.e., via the first vertical wall 90 of the auxiliary member 48).

FIG. 14~FIG. 19 show how the self-closing mechanism 16 is released from a failure state by means of the second positioning groove 28 of the second rail 14 so that the self-closing slide rail assembly 10 can resume normal operation.

Figure 14:
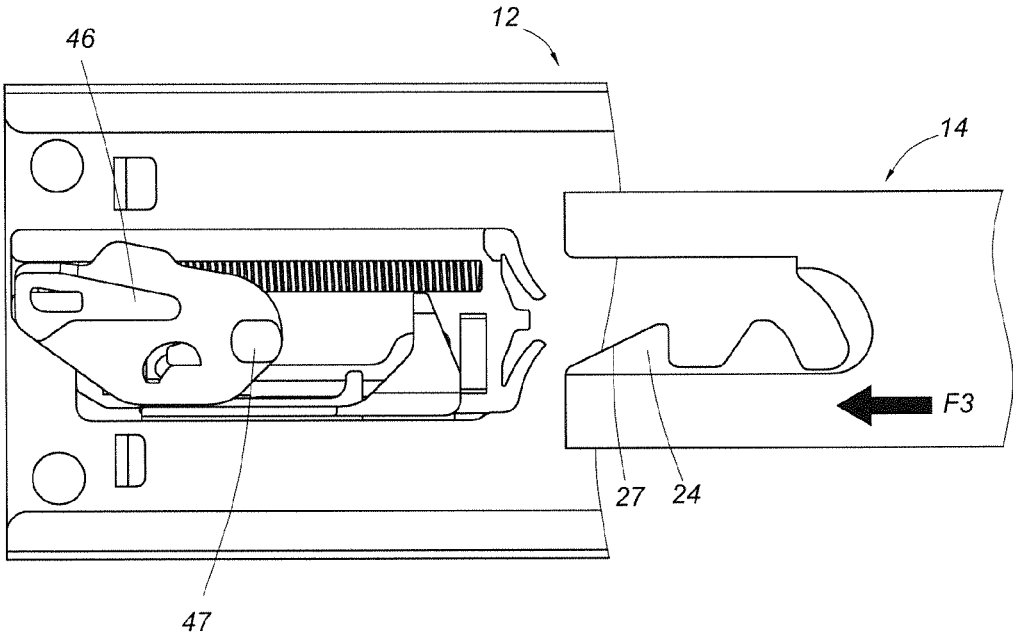
FIG. 14 shows how the self-closing mechanism in an embodiment of the present invention is released from a failure state by means of the second positioning groove of the second rail.
Figure 15:
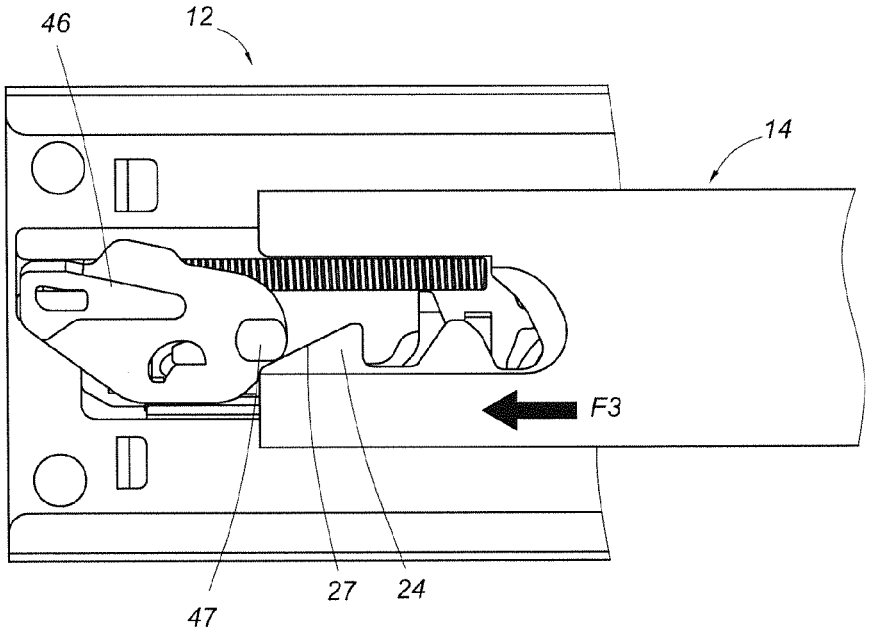
FIG. 15 is another drawing showing how the self-closing mechanism in an embodiment of the present invention is released from a failure state by means of the second positioning groove of the second rail.

When the self-closing mechanism 16 is in a failure state, referring to FIG. 14 and FIG. 15, the first step of failure elimination is to apply an external force F3 which displaces the second rail 14 relative to the first rail 12 toward the retracted position. The goal is to press the actuating portion 47 of the movable member 46 with the inclined side 27 of the hook portion 24 of the second rail 14.

Figure 16A:
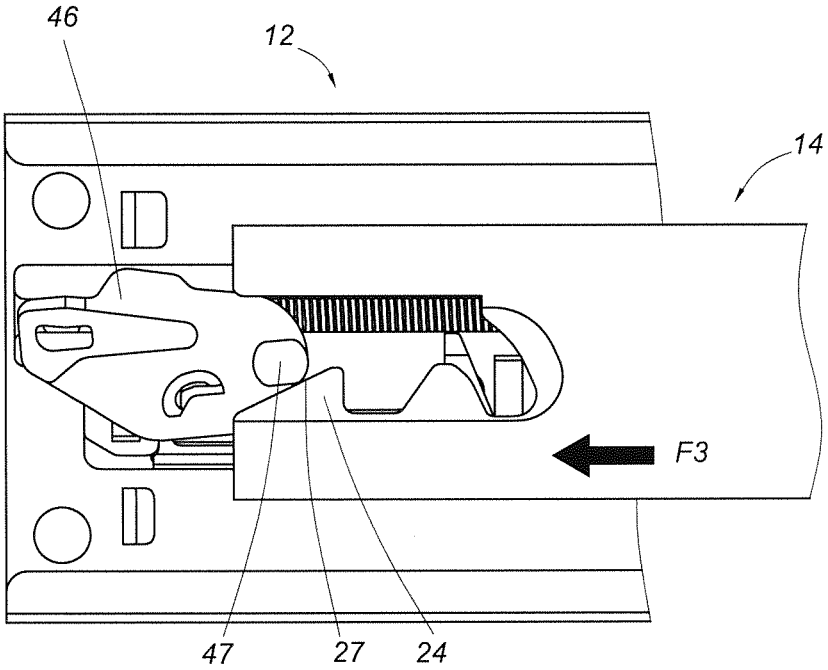
FIG. 16A is yet another drawing showing how the self-closing mechanism in an embodiment of the present invention is released from a failure state by means of the second positioning groove of the second rail.
Figure 16B:
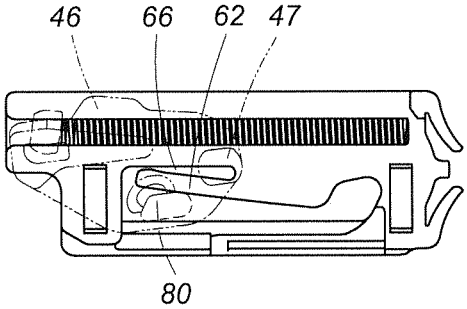
FIG. 16B schematically shows how, when the self-closing mechanism in an embodiment of the present invention is in a failure state, the second projection of the movable member is pushed by a hook portion of the second rail and in turn presses against a portion of a longitudinal wall, thereby deflecting the longitudinal wall into a space.
Figure 17:
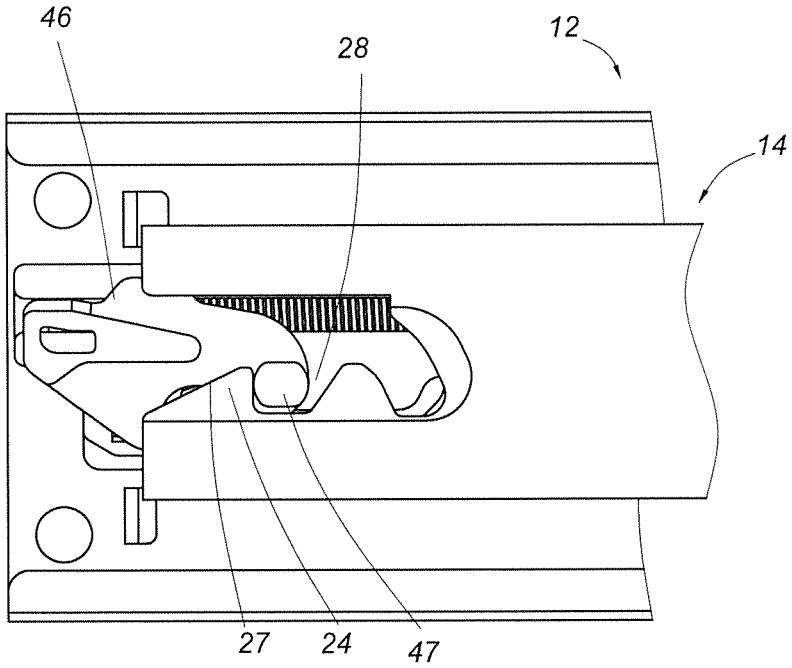
FIG. 17 is still another drawing showing how the self-closing mechanism in an embodiment of the present invention is released from a failure state by means of the second positioning groove of the second rail.

Then, referring to FIG. 16A, FIG. 16B, and FIG. 17, the inclined side 27 of the hook portion 24 of the second rail 14 is kept pressed against the actuating portion 47 of the movable member 46 such that, with the second projection 80 of the movable member 46 pressing against a portion of the longitudinal wall 62 and thus deflecting the longitudinal wall 62 into the space 66 (see FIG. 16B), the actuating portion 47 of the movable member 46 is guided by the inclined side 27 of the second rail 14 into engagement with the second positioning groove 28.

Figure 18:
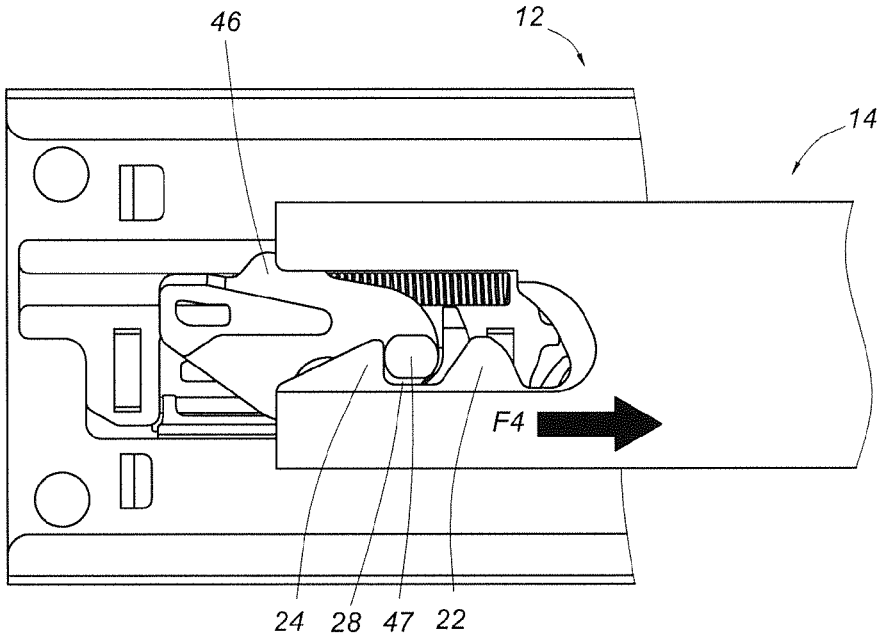
FIG. 18 is a further drawing showing how the self-closing mechanism in an embodiment of the present invention is released from a failure state by means of the second positioning groove of the second rail.
Figure 19:
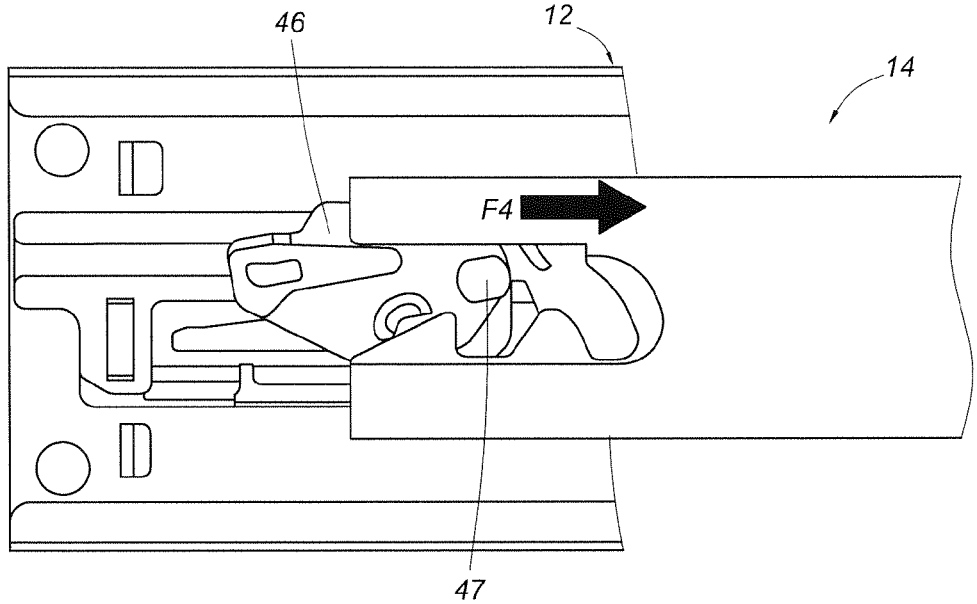
FIG. 19 is one more drawing showing how the self-closing mechanism in an embodiment of the present invention is released from a failure state by means of the second positioning groove of the second rail.

Referring to FIG. 18 and FIG. 19, once the actuating portion 47 of the movable member 46 is engaged in the second positioning groove 28 between the hook portion 24 and the stop portion 22 of the second rail 14, another external force F4 is applied to displace the second rail 14 relative to the first rail 12 from the retracted position toward an extended position. The goal is to drive the movable member 46 with the second rail 14 until the second projection 80 of the movable member 46 is moved from the first edge 58 to the second edge 60 and engaged with the engaging portion 42 (see FIG. 10B). Thus, the self-closing mechanism 16 recovers from the failure state and can function properly again.

While the present invention has been disclosed through the foregoing preferred embodiments, the embodiments are not intended to be restrictive of the present invention. The scope of patent protection sought by the applicant is defined by the appended claims.

The invention claimed is:

1. A self-closing slide rail assembly, comprising:

a first rail;

a second rail longitudinally displaceable relative to the first rail, the second rail including a guide portion and a stop portion adjacent to the guide portion, the guide portion and the stop portion defining a first positioning groove therebetween; and a self-closing mechanism mounted on the first rail and including:

a housing including: a longitudinal portion, a transverse portion connected to the longitudinal portion, a first edge substantially parallel to the longitudinal portion, a second edge deflecting from the first edge, and an engaging portion located at the second edge;

an elastic member located in the longitudinal portion of the housing;

a movable member movably connected to the housing, the movable member including a first side and a second side opposite the first side, the first side including a first projection and a second projection, the first projection being pressed against the elastic member, the second projection corresponding to the transverse portion and being movable along the first edge; and an actuating portion connected to the second side of the movable member, the actuating portion corresponding in shape to the first positioning groove between the guide portion and the stop portion of the second rail; and an auxiliary member movably connected to the housing, the auxiliary member being displaceable relative to the movable member, the auxiliary member being selectively engaged by the movable member for displacement therewith;

wherein when the actuating portion of the self-closing mechanism is engaged in the first positioning groove of the second rail and the second rail is displaced relative to the first rail from a retracted position toward an extended position, the second projection of the movable member is moved from the first edge to the second edge and enters into engagement with the engaging portion, and the elastic member of the self-closing mechanism stores elastic energy; and when the second rail is displaced relative to the first rail from the extended position toward the retracted position, the guide portion of the second rail guides the actuating portion of the self-closing mechanism into engagement with the first positioning groove of the second rail such that the second projection of the movable member displaces from the engaging portion and, as the elastic member of the self-closing mechanism releases the elastic energy, is moved from the second edge to the first edge, the movable member thereby automatically driving the second rail back to the retracted position.

2. The self-closing slide rail assembly of claim 1, wherein the housing of the self-closing mechanism further comprises a channel filled with a cushioning medium; the auxiliary member having a sliding portion corresponding to the channel, a first vertical wall, and a second vertical wall opposite the first vertical wall; and the second projection of the movable member is located between the first vertical wall and the second vertical wall of the auxiliary member.

3. The self-closing slide rail assembly of claim 2, wherein the auxiliary member further comprises a lateral extension portion corresponding to the movable member.

4. The self-closing slide rail assembly of claim 1, wherein the housing further comprises a longitudinal wall connected to the longitudinal portion, a space is formed between a portion of the longitudinal wall and the longitudinal portion, and the first edge is located on the longitudinal wall.

5. The self-closing slide rail assembly of claim 1, wherein the second rail further comprises a hook portion adjacent to the stop portion, the hook portion and the stop portion define a second positioning groove therebetween, and the second positioning groove corresponds in shape to the actuating portion of the self-closing mechanism.

6. The self-closing slide rail assembly of claim 1, wherein the first rail further comprises an end portion, the self-closing mechanism is mounted on the first rail and adjacent to the end portion thereof, the second rail further comprises an end portion corresponding to the self-closing mechanism, and the guide portion is adjacent to the end portion of the second rail.

7. The self-closing slide rail assembly of claim 1, wherein the longitudinal portion of the housing further comprises an accommodation space, and the elastic member is located in the accommodation space.

8. A self-closing slide rail assembly, comprising:

a first rail;

a second rail longitudinally displaceable relative to the first rail, the second rail including a guide portion and a stop portion adjacent to the guide portion, the guide portion and the stop portion defining a positioning groove therebetween; and a self-closing mechanism mounted on the first rail and including:

a housing including: a first edge, a second edge deflecting from the first edge, and an engaging portion adjacent to the second edge;

an elastic member located in the housing;

a movable member having at least a portion corresponding in shape to the positioning groove between the guide portion and the stop portion of the second rail, the movable member having a first projection pressed against the elastic member, wherein the movable member is movable between the first edge and the second edge of the housing in response to elastic energy provided by the elastic member and is engaged with the engaging portion when moved to the second edge of the housing; and an auxiliary member movably connected to the housing, the auxiliary member being displaceable relative to the movable member, the auxiliary member being selectively engaged by the movable member for displacement therewith.

9. The self-closing slide rail assembly of claim 8, wherein the housing further comprises a longitudinal portion and a transverse portion connected to the longitudinal portion, the first edge is substantially parallel to the longitudinal portion, and the elastic member is located in the longitudinal portion of the housing.

10. The self-closing slide rail assembly of claim 9, wherein the movable member is movably connected to the housing, the movable member comprises a first side and a second side opposite the first side, the first projection is located on the first side, the first side further comprises a second projection, the second projection corresponds to the transverse portion and is movable along the first edge, the self-closing mechanism further comprises an actuating portion connected to the second side of the movable member, and the actuating portion corresponds in shape to the positioning groove between the guide portion and the stop portion of the second rail.

11. A self-closing mechanism for use in a slide rail assembly, the self-closing mechanism comprising:

a housing including: a longitudinal portion, a transverse portion connected to the longitudinal portion, a first edge substantially parallel to the longitudinal portion, a second edge deflecting from the first edge, and an engaging portion located at the second edge;

an elastic member located in the longitudinal portion of the housing;

a movable member movably connected to the housing, the movable member including a first side and a second side opposite the first side, the first side including a first projection and a second projection, the first projection being pressed against the elastic member, the second projection corresponding to the transverse portion and being movable along the first edge, the movable member being movable between the first edge and the second edge to enter into engagement with the engaging portion via the second projection; and an actuating portion connected to the second side of the movable member; and an auxiliary member movably connected to the housing, the auxiliary member being displaceable relative to the movable member, the auxiliary member being selectively engaged by the movable member for displacement therewith.

12. The self-closing mechanism of claim 11, wherein the housing further comprises a channel filled with a cushioning medium; and the auxiliary member has a sliding portion corresponding to the channel, a first vertical wall, and a second vertical wall opposite the first vertical wall; and the second projection of the movable member is located between the first vertical wall and the second vertical wall of the auxiliary member.

13. The self-closing mechanism of claim 12, wherein the auxiliary member further comprises a lateral extension portion corresponding to the movable member.

14. The self-closing mechanism of claim 11, wherein the longitudinal portion of the housing further comprises an accommodation space, and the elastic member is located in the accommodation space.

* * * * *